US008413554B2

(12) United States Patent
Lee

(10) Patent No.: US 8,413,554 B2
(45) **Date of Patent: *Apr. 9, 2013**

(54) UNIDIRECTIONAL RATCHET WRENCH

(75) Inventor: Li-Ju Lee, Taichung (TW)

(73) Assignee: Kung-Cheng Chen, Taichung (TW)

( * ) Notice: Subject to any disclaimer, the term of this patent is extended or adjusted under 35 U.S.C. 154(b) by 337 days.

This patent is subject to a terminal disclaimer.

(21) Appl. No.: 12/876,909

(22) Filed: Sep. 7, 2010

(65) Prior Publication Data

US 2010/0326245 A1 Dec. 30, 2010

Related U.S. Application Data

(63) Continuation-in-part of application No. 12/332,428, filed on Dec. 11, 2008, now abandoned.

(51) Int. Cl.
*B25B 13/12* (2006.01)
*B25B 13/46* (2006.01)

(52) U.S. Cl.
USPC ..... 81/179; 81/186

(58) Field of Classification Search ..... 81/179, 81/186, 128, 165
See application file for complete search history.

(56) References Cited

U.S. PATENT DOCUMENTS

| | | | | |
|---|---|---|---|---|
| 365,019 | A | 6/1887 | Phillips | |
| 385,595 | A | 7/1888 | Chappell | |
| 2,489,057 | A | 11/1949 | Laurence | |
| 4,158,975 | A | 6/1979 | DeSousa | |
| 4,706,528 | A | 11/1987 | Inoue | |
| 5,018,412 | A | 5/1991 | Wylie, III | |
| 5,381,710 | A | 1/1995 | Baker | |
| 5,878,636 | A * | 3/1999 | Baker | 81/186 |
| 6,739,223 | B2 | 5/2004 | Wu | |
| 7,827,887 | B2 * | 11/2010 | Lee | 81/179 |
| 7,878,095 | B2 * | 2/2011 | Wu | 81/179 |

* cited by examiner

*Primary Examiner* — Hadi Shakeri
(74) *Attorney, Agent, or Firm* — patenttm.us

(57) ABSTRACT

A unidirectional ratchet wrench has a head and a ratcheting assembly. The head has a stationary jaw and a ratchet jaw. The stationary jaw is formed on and protrudes from the head and has an undulating surface. The ratchet jaw is formed on and protrudes from the head and has an arced slot formed in an inner surface of the ratchet jaw. The ratcheting assembly has an engaging tab being movably mounted in the arced slot and selectively engaging and disengaging a tool head with the inner surface of the stationary jaw when the wrench is respectively rotated in drive and non-drive directions.

16 Claims, 13 Drawing Sheets

UNIDIRECTIONAL RATCHET WRENCH

The present invention is a continuation-in-part (CIP) application of the application Ser. No. 12/332,428, filed on Dec. 11, 2008.

BACKGROUND OF THE INVENTION

1. Field of the Invention

The present invention relates to a wrench, especially to a unidirectional ratchet wrench.

2. Description of the Prior Arts

With reference to FIG. 7, a conventional unidirectional ratchet wrench is used to drive a bolt and comprises a handle, a head 40 and a ratchet assembly.

The head 40 is formed on the handle and has two edges, a stationary jaw 42, a ratchet jaw 43 and a cavity 41.

The stationary jaw 42 is formed on and protrudes from one edge of the head 40 and has an inner surface.

The ratchet jaw 43 is formed on and protrudes from the other edge of the head 40 and has an inner surface, a slot 431, two recesses 432 and two sides. The slot 431 is defined in the inner surface of the ratchet jaw 43 and has an inner end. The recesses 432 are defined in the sides of the ratchet jaw 43 and communicate with the slot 431.

The cavity 41 is formed between the jaws 42, 43 and has a peripheral surface and multiple recesses. The multiple recesses are formed in the peripheral surface of the cavity 41 at intervals to provide a ratcheting space when the head 40 is rotated around a bolt head in a non-drive direction.

The ratcheting assembly is mounted in the ratchet jaw 43 and has a tapered coil spring 44, a retractable tab 45 and two cover plates 46.

The tapered coil spring 44 is mounted in the slot 431 and has an outer end.

The retractable tab 45 is moveably mounted in the slot 431 and has an abutting surface. The retractable tab 45 abuts the outer end of the tapered coil spring 44. The abutting surface of the retractable tab 45 projects into the cavity 41.

The two cover plates 46 are respectively mounted in the recesses 432 in the ratchet jaw 43.

The bolt head has multiple flats and multiple corners formed between adjacent flats. When using the conventional unidirectional ratchet wrench, the peripheral surface of the cavity 41 and the abutting surface of the retractable tab 45 engage the flats of the bolt head. In order to tighten the blot, a torque is applied to the blot head by a turning stroke in the drive direction. When the conventional unidirectional ratchet wrench is rotated in the non-drive direction the retractable tab 45 is pressed into the slot 43 by the corners of the bolt head to disengage the tab 45 from the blot head. Thus, the head 40 can be rotated in the non-drive direction to allow the conventional unidirectional ratchet wrench to be rotated within a limited arc without realigning the head 40 of the wrench with the bolt head. Repeated drive and non-drive rotations tighten or loosen the bolt conveniently. The conventional unidirectional ratchet wrench may be turned over to reverse the drive direction.

Although the tapered coil spring 44 allows the slot 431 to be made shallower and smaller than using a normal coil spring, thereby allowing miniaturization of the conventional unidirectional ratchet wrench, the tapered coil spring 44 is significantly more expensive than a normal coil spring. The ratchet jaw 43 must be thick enough to accommodate the tapered coil spring 44 so limiting miniaturization of the conventional wrench and causing structural weakness to the ratchet jaw 44, thereby preventing application of the conventional unidirectional ratchet wrench to small sized bolts.

Further, the inner end of the slot 431 has to be precisely formed so production of the wrench conventional ratchet requires a precise casting process, linear cutting or LASER cutting, which significantly raises manufacturing cost and may even require two cutting processes during production.

Moreover, the retractable tab 45 of the conventional unidirectional ratchet wrench retracts into the slot 431 in a linear movement, so the abutting surface of the retractable tab 45 projects out from the recession 431 and provides only a small area for contacting the bolt head. Such structure may cause unexpected and unsafe slippage during use. Also, due to limited movement, the retractable tab 45 cannot be used on slightly rounded, damaged or non-standard sized bolt heads.

Each recess of the ratchet jaw 43 may be provided with two projections 432 to facilitate connection of a corresponding cover plate 46. When attaching the cover plates 46, the projections 432 are melted and welded with the cover plates 46. However, visible welding marks appear on and around the cover plate 46. Furthermore, the cover plates 46 do not reinforce the ratchet jaw 43 and may be removed by accidentally dropping the conventional ratchet.

With reference to FIGS. 11 and 12, U.S. Pat. No. 4,158,975, entitled to "Unidirectional Gripping Open End Wrench" discloses a D-shaped piece 50 movably mounted in a cavity defined in a head of the wrench and is connected to a helical compression spring 52. However, the wrench of the '975 Patent still needs a spring 52 to recover the D-shaped pieces 50, to assemble the wrench of the '975 is difficult. In addition, the D-shaped piece 50 of the '975 Patent is designed to abut completely with a flat of a bolt head with the straight edge. However, when the wrench of the '975 Patent is rotated in a slip action, the straight edge of the D-shaped piece 50 will push against one of the corners of the bolt head to cause the head of the wrench of the '975 Patent away from the bolt head. Consequently, the head of the wrench of the '975 Patent may disengage from the bolt head during the slip action and this will cause inconvenience to the operation of the wrench of the '975 Patent.

With reference to FIGS. 13 and 14, U.S. Pat. No. 5,018,412, entitled to "Open-End Ratchet Wrench" discloses a jaw portion 60 operatably mounted on an end of a handle element 62 and is connected to a spring 64. However, the wrench of the '412 Patent also needs a spring 64 to cause difficulty in assembling the wrench. In addition, multiple notches 602,612 separated from each other in 30 degree have to be formed in the jaws 60,61 for holding corners of the bolt head inside during a drive and non-drive direction, but the notches 602, 612 will cause complicate in structure of the wrench of the '412.

With reference to FIG. 15, U.S. Pat. No. 4,706,528, entitled to "Adjustable Wrench" discloses a sliding jaw 70 slidably mounted on an end of a handle 72 and is connected to a coil spring 74 and a plate spring 76. The wrench of the '528 needs two springs 74,76 for the operation of the sliding jaw 70, so the structure of the wrench of the 528 Patent is complicated. In addition, when the wrench of the '528 Patent is applied to a tool having a hexagonal head, the head of the wrench of the '528 Patent will also be pushed away from the bolt head by the corners of the bolt head. Thus, the head of the wrench of the '528 Patent may disengage from the bolt head during the non-drive direction, so the '528 Patent has a ratchet function only when being applied to an object having a circular cross section. The '528 Patent will lose the ratchet function when being applied to a tool head having a hexagonal cross section and is inconvenient in operation.

With reference to FIG. 16, U.S. Pat. No. 385,595, entitled to "Pipe Wrench" discloses a jaw 80 slidably mounted on an end of a handle 82 and has multiple teeth. However, the pipe wrench of the '595 Patent can only be applied to rotate an object having a circular cross section, such as a pipe but cannot be applied to rotate a tool head having a hexagonal cross section.

To overcome the shortcomings, the present invention provides a unidirectional ratchet wrench to mitigate or obviate the aforementioned problems.

SUMMARY OF THE INVENTION

The main objective of the invention is to provide a unidirectional ratchet wrench overcoming the problems or shortcomings of the conventional unidirectional ratchet wrench.

The unidirectional ratchet wrench in accordance with the present invention has a wrench body and a ratcheting assembly. The wrench body has a head and a curved slot. The head has an inner surface. The curved slot is formed in the inner surface of the head. The ratcheting assembly is slidably mounted in the curved slot for applying a torque to a blot head during a rotation in the forward direction as well as for ratcheting rotation during a non-drive rotation. Other objectives, advantages and novel features of the invention will become more apparent from the following detailed description when taken in conjunction with the accompanying drawings.

DETAILED DESCRIPTION OF THE PREFERRED EMBODIMENTS

Figure 1:
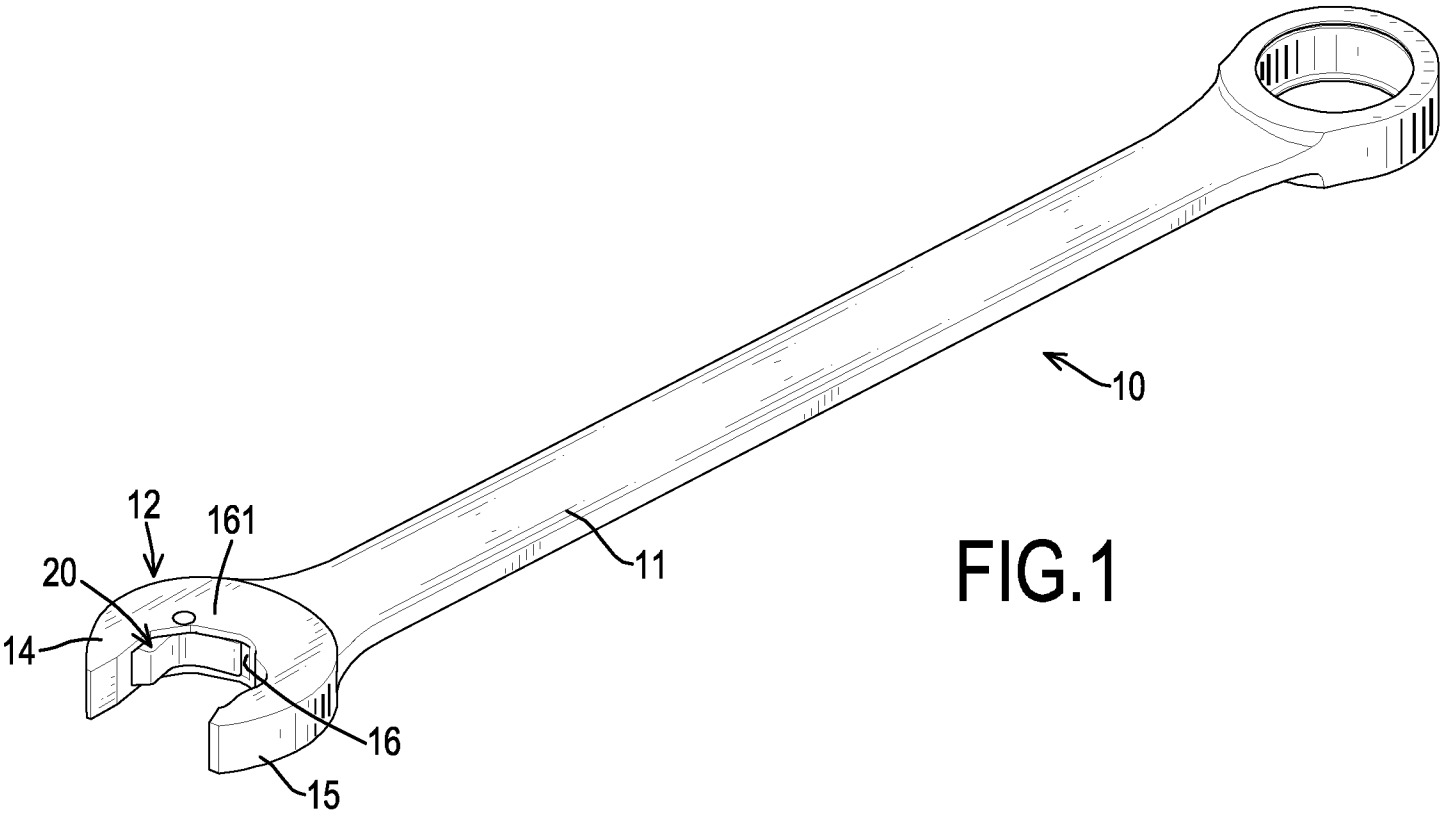
FIG. 1 is a perspective view of a unidirectional ratchet wrench in accordance with the present invention.
Figure 2:
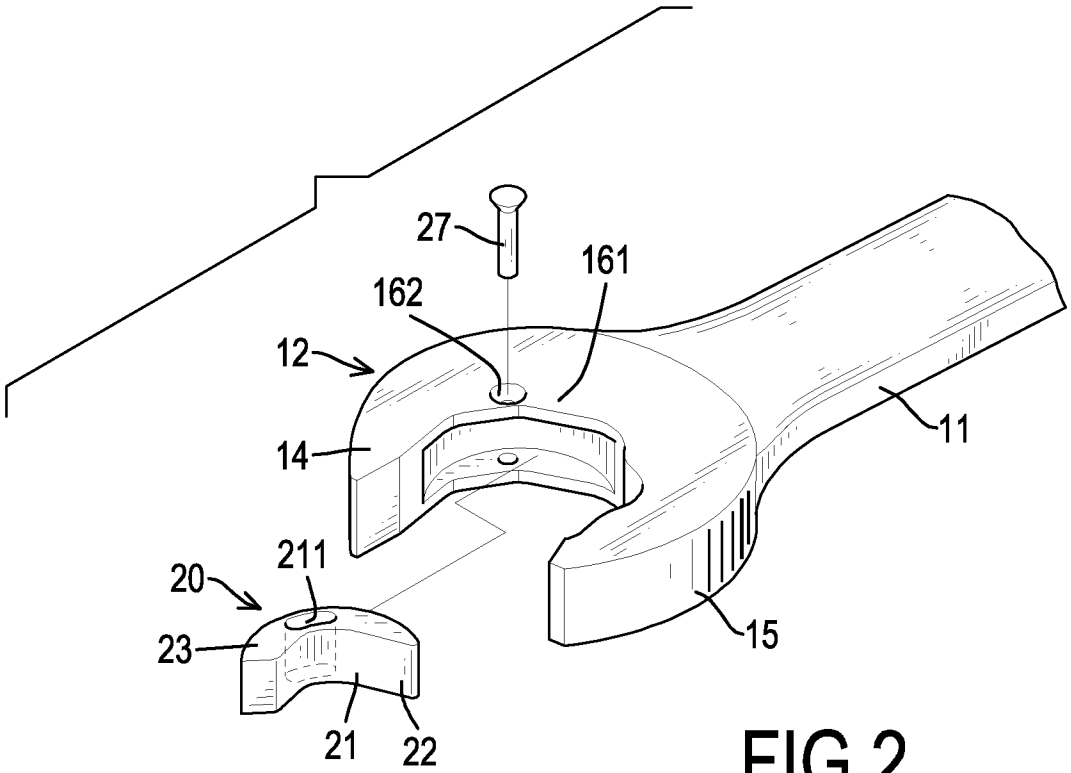
FIG. 2 is an enlarged exploded perspective view of the unidirectional ratchet wrench in FIG. 1.

With reference to FIGS. 1 and 2, a unidirectional ratchet wrench in accordance with the present invention comprises a wrench body 10 and a ratcheting assembly 20.

The wrench body 10 has a handle 11 and a head 12.

The head 12 is formed on and protrudes from the handle 11 and has two edges, a stationary jaw 15 and a ratchet jaw 14.

Figure 3A:
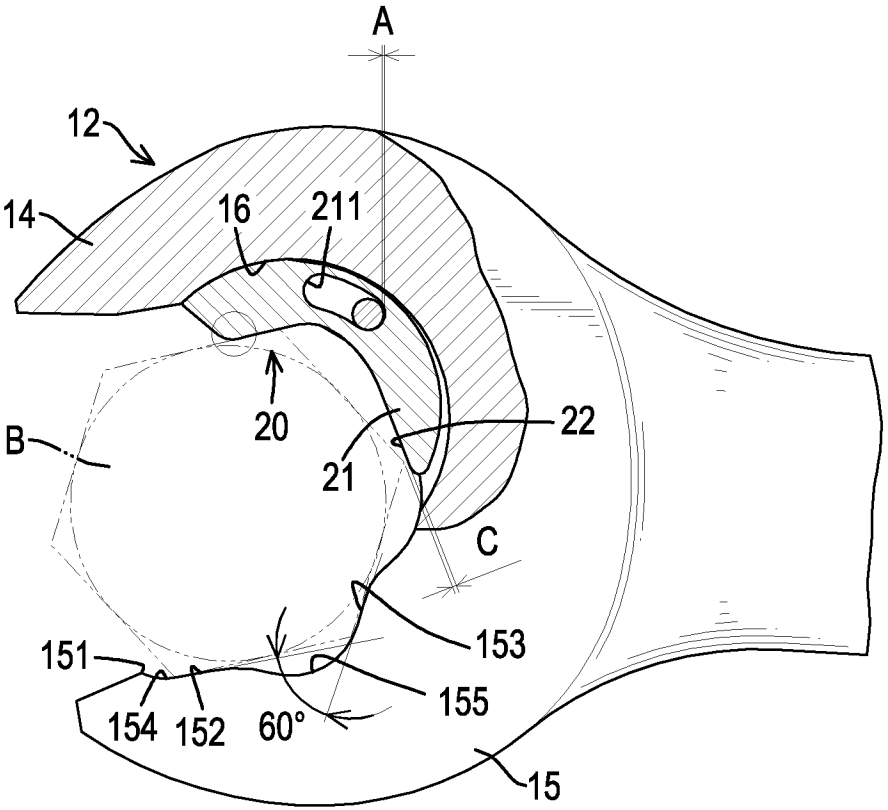
FIG. 3A is an operational top view in partial section of the unidirectional ratchet wrench in FIG. 1, showing a head of the wrench being aligned with a bolt.
Figure 3B:
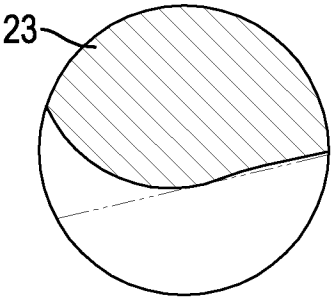
FIG. 3B is an enlarged view of a blunt end of an engaging tab of the ratchet wrench in FIG. 1.

With further reference to FIGS. 3A and 3B, the stationary jaw 15 is formed on and protrudes from one edge of the head 12 and has an undulating surface. The undulating surface may have a distal end, a limiting protrusion 151, a supporting protrusion 153 and an engaging protrusion 152. The limiting protrusion 151 is formed on and protrudes from the undulating surface of the stationary jaw 15 adjacent to the distal end of the undulating surface. The supporting protrusion 153 is formed on the undulating surface adjacent to the handle 11. The engaging protrusion 152 is formed on the undulating surface of the stationary jaw 15 between the limiting protrusion 151 and the supporting protrusion 153 and has a tangent line having an included angle relative to a tangent line of the supporting protrusion 153. The included angle between the tangent lines of the supporting protrusion 153 and the engaging protrusion 152 may be 60 degrees. Additionally, a first recess 154 with a curved bottom is defined between the limiting protrusion 151 and the engaging protrusion 152, and a second recess 155 with a curved bottom is defined between the engaging protrusion 152 and the supporting protrusion 153.

Figure 4:
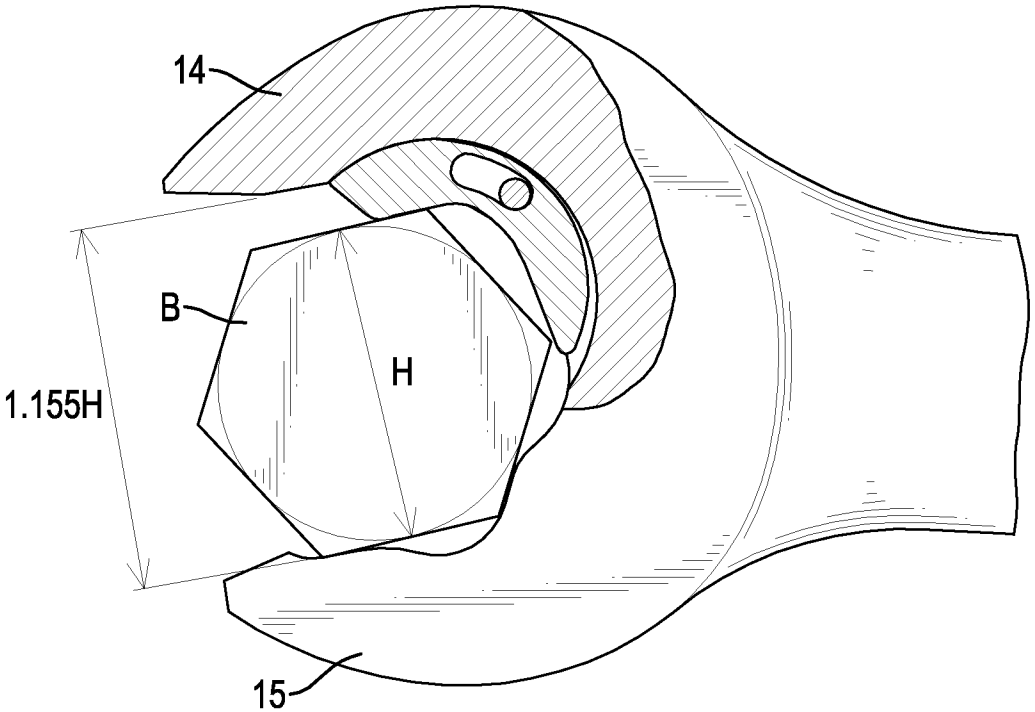
FIG. 4 is an enlarged top view in partial section of the unidirectional ratchet wrench in FIG. 1 showing that the space between the ratchet and stationary jaws has a width being 1.155 times of the diameter of a tool head.

The ratchet jaw 14 is formed on and protrudes from the other edge of the head 12 to form a space between the ratchet jaw 14 and the stationary jaw 15 for holding a tool head B, such as a head of a bolt or a nut. The space has a width may be 1.155 times of a diameter H of the tool head B as shown in FIG. 4.

The ratchet jaw 14 has an inner surface, an arced slot 16, two side surfaces 161, two pinholes 162 and a distal end away from the handle.

The inner surface of the ratchet jaw 14 may comprise multiple beveled surfaces.

The arced slot 16 is formed in the inner surface of the ratchet jaw 14 and has a curved inner surface.

The pinholes 162 are respectively formed through the side surfaces of the ratchet jaw 14 and communicate with the arced slot 16.

The ratcheting assembly 20 is mounted in the arced slot 16 and has an engaging tab 21 and a pin 27.

The engaging tab 21 is movably mounted in the arced slot 16, is arced and has a tip end 22, 1 blunt end 23, an inner surface, an outer surface and a guide hole 211. The blunt end 23 of the engaging tab 21 is adjacent to the distal end of the ratchet jaw 14, extends out of the arced slot 16 and into the space between the ratchet jaw 14 and the stationary jaw 15 and may have a rounded corner on the inner surface of the engaging tab 21. The tip end 22 is away from the distal end of the ratchet jaw 14 and extends out of the arced slot 16 and into the space between the ratchet jaw 14 and the stationary jaw 15. Additionally, the blunt end 23 has a width wider than that of the tip end 22.

The outer surface of the engaging tab 21 is curved and selectively abuts the inner surface of the arced slot 16. The outer surface of the engaging tab 21 has a curvature same as or different from that of the curved inner surface of the arced slot 16. If the outer surface of the engaging tab 21 has a curvature same as that of the curved inner surface of the arced slot 16, the outer surface of the engaging tab 21 is in contact completely with the curved inner surface of the arced slot 16. If the outer surface of the engaging tab 21 has a curvature different from that of the curved inner surface of the arced slot 16, the outer surface of the engaging tab 21 has a first segment in contact completely with a part of the curved inner surface of the arced slot 16 and a second segment away from the curved inner surface of the arced slot 16.

The inner surface of the engaging tab 21 may be recessed to form a depression in the inner surface of the engaging tab 21.

Figure 5:
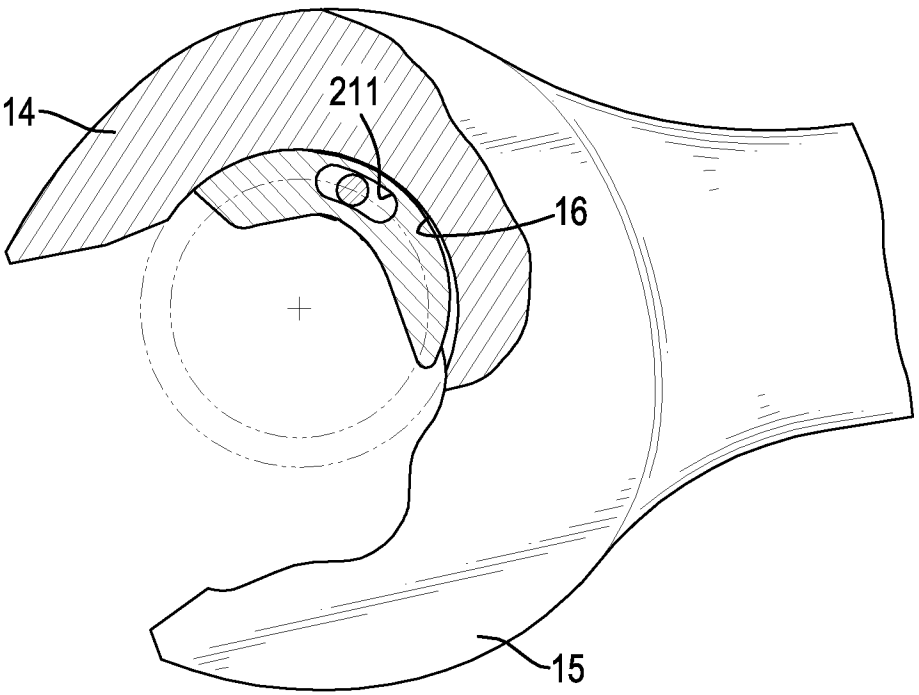
FIG. 5 is an enlarged top view in partial section of the unidirectional ratchet wrench in FIG. 1 showing that the curved guide hole has a center same as that of the curved inner surface of the arced slot.

The guide hole 211 is formed through the engaging tab 21, is curved and has a drive end and a non-drive end. The non-drive end of the guide hole 211 is disposed near the blunt end 23 of the engaging tab 21. The drive end of the guide hole 211 is disposed opposite to the non-drive end of the guide hole 211. In addition, the curved guide hole 211 has a center same as that of the curved inner surface of the arced slot 16 as shown in FIG. 5.

The pin 27 is mounted movably through the guide hole 211 and securely in the side surfaces of the ratchet jaw 14, may be in the pinholes 162.

Figure 6:
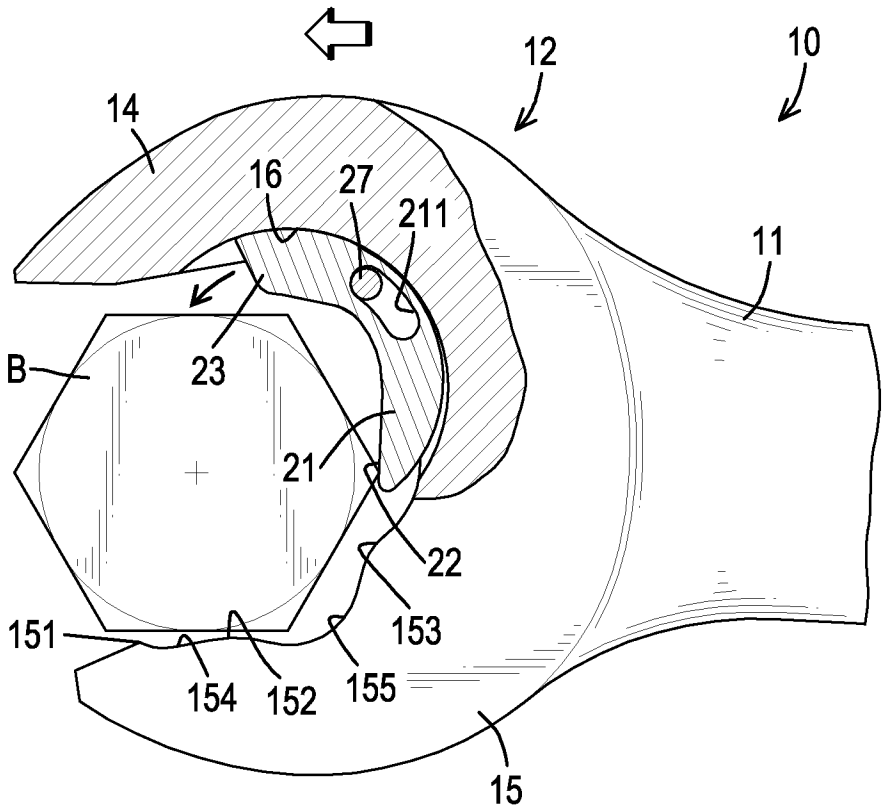
FIG. 6 is an operational top view in partial section of the unidirectional ratchet wrench in FIG. 3A, showing the engaging tab abutting the tool head.

With reference to FIGS. 3 and 6, a ratcheting space A is formed between the drive end of the guide hole 211 and the pin 27 to allow the ratcheting assembly 20 to slightly slide in a non-drive direction. When a tool head B having multiple flats and corners disposed between adjacent flats requires tightening or loosening, the head 12 of the unidirectional ratchet wrench as described is mounted around the tool head B. A rotating space C is formed between the tip end 22 of the engaging tab 21 and one corner of the tool head B allows the ratcheting assembly 20 to slide around the bolt B. The blunt end 23 of the engaging tab 21 engages the tool head B when the pin 27 abuts the drive end of the guide hole 211.

Figure 7:
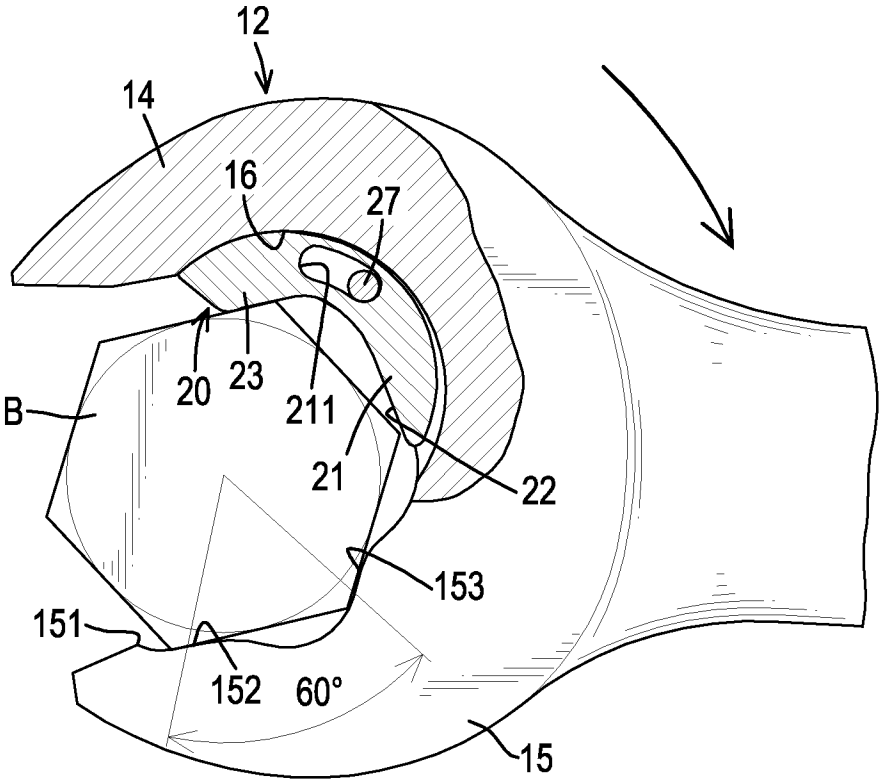
FIG. 7 is an enlarged top view in partial section of the unidirectional ratchet wrench in FIG. 1, showing the engaging tab engaging the tool head.

With further reference to FIGS. 3 and 7, the flats of the tool head B abut the engaging protrusion 152 and the supporting protrusion 153 of the stationary jaw 15 and the rounded corner on the engaging tab 21 at positions near the corners of the tool head B. At this time, the contacting points of the engaging protrusion 152 and the supporting protrusion 153 with the corresponding flats on the tool head B have an included angle of 60 degree. Therefore, the handle 11 is rotated in a drive direction to turn the tool head B.

Figure 8:
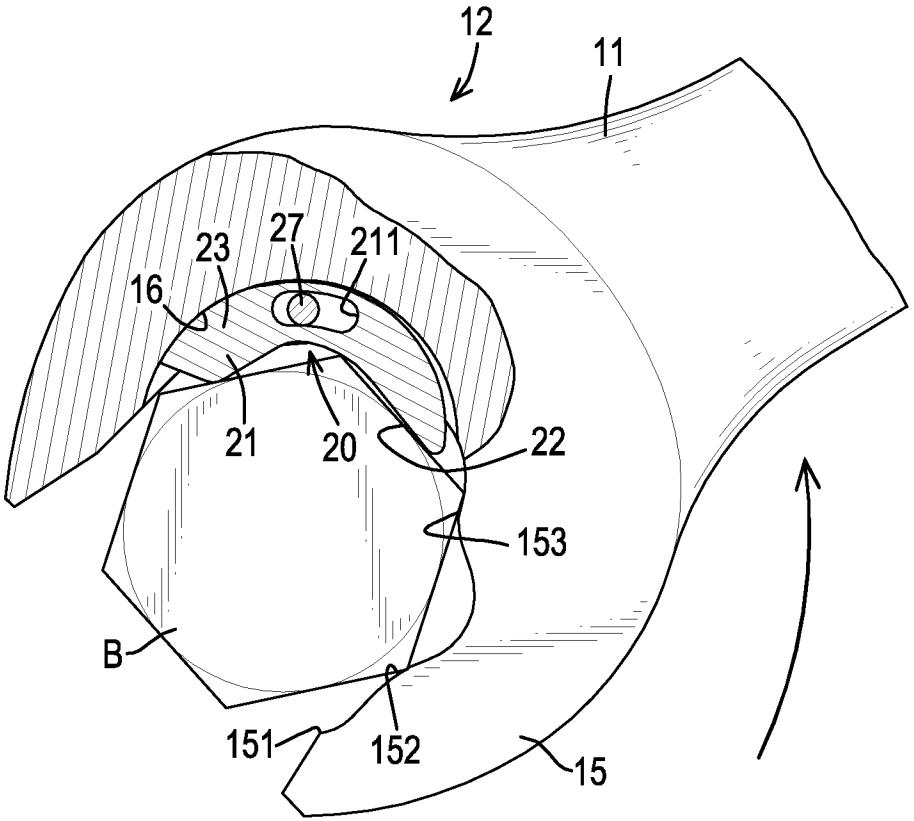
FIG. 8 is an operational top view in partial section of the unidirectional ratchet wrench in FIG. 1, showing the head moving in a non-drive direction.

When the handle 11 is rotated in a non-drive direction, with reference to FIG. 8, the engaging tab 21 slides along the pin 27, and the tip end 22 of the engaging tab 21 extends out of the arced slot 16 and further into the space between the jaws 14, 15 and the blunt end 23 of the engaging tab 21 retracts into the arced slot 16. The head 12 of the wrench is rotated relative to the tool head B to make corners of the tool head B rotating over the protrusions 151, 152, 153 of the stationary jaw 15 and the rounded corner on the blunt end 23 of the engaging tab 21 through the recesses 154,155 between the protrusions 151, 152, 153 of the stationary jaw 15 and the depression in the inner surface of the engaging tab 21. Accordingly, the head 12 of the wrench can be rotated at a center substantially at the center of the tool head B, so that the tool head B can be kept held in the space between ratchet jaw 14 and the stationary jaw 15 to prevent from escaping from the space while the wrench is rotated in the non-drive direction. The wrench can be easily rotated to a position where the engaging tab 21 and the engaging and supporting protrusions 152,153 re-engage the tool head B to allow the wrench being rotated in the drive direction for fastening or loosening the tool.

Figure 9:
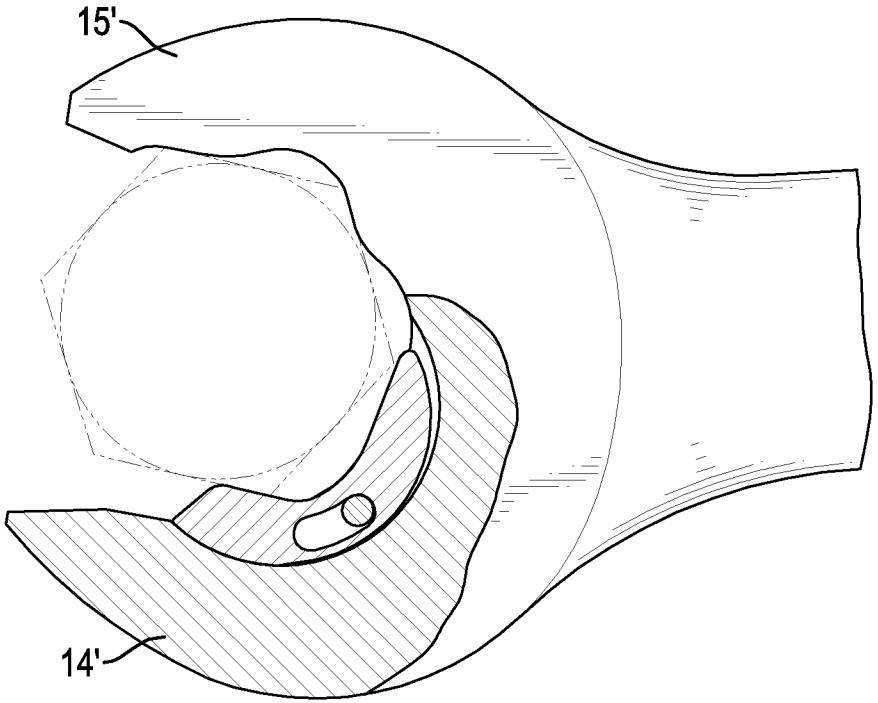
FIG. 9 is an enlarged top view in partial section of an alternative embodiment of a unidirectional ratchet wrench in accordance with the present invention.
Figure 10:
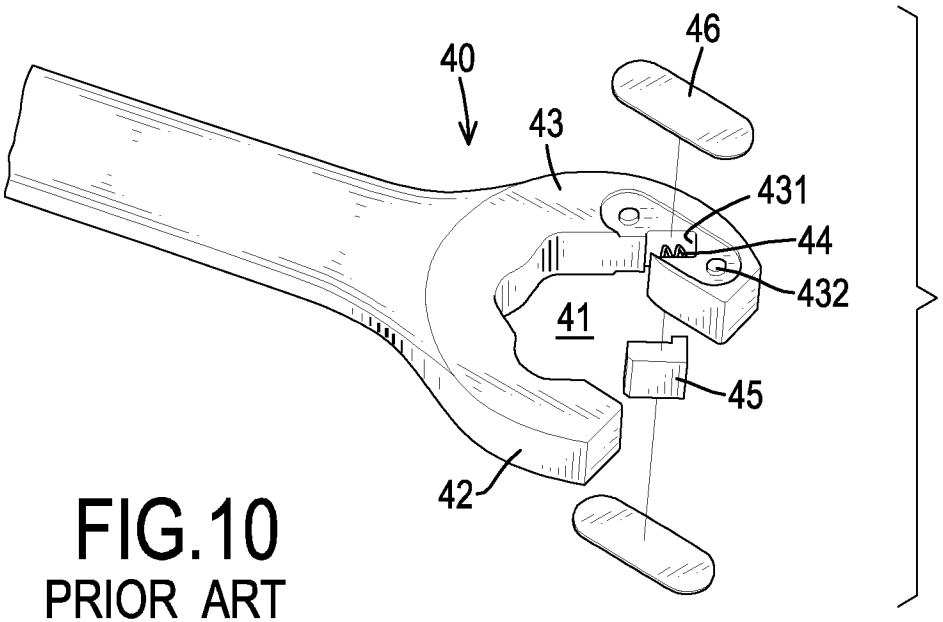
FIG.10 PRIOR ART
FIG. 10 is an exploded perspective view of a conventional unidirectional ratchet wrench in accordance with the prior art.
Figure 12:
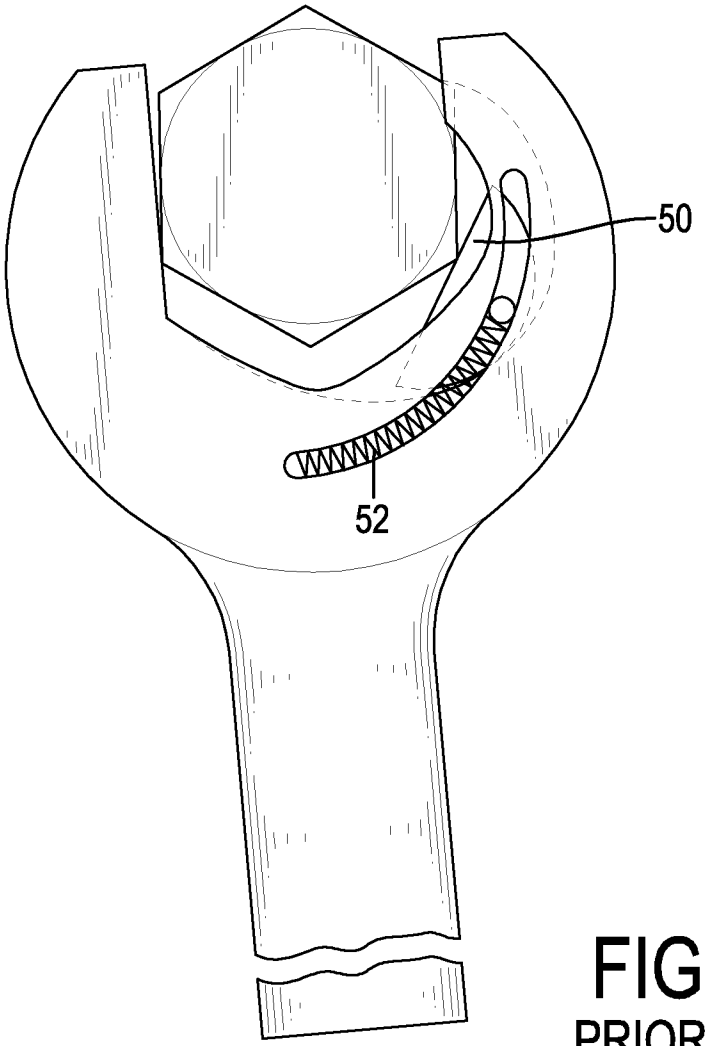
FIG.12 PRIOR ART
FIGS. 11 and 12 are side views of another conventional wrench shown in U.S. Pat. No. 4,158,975.
Figure 11:
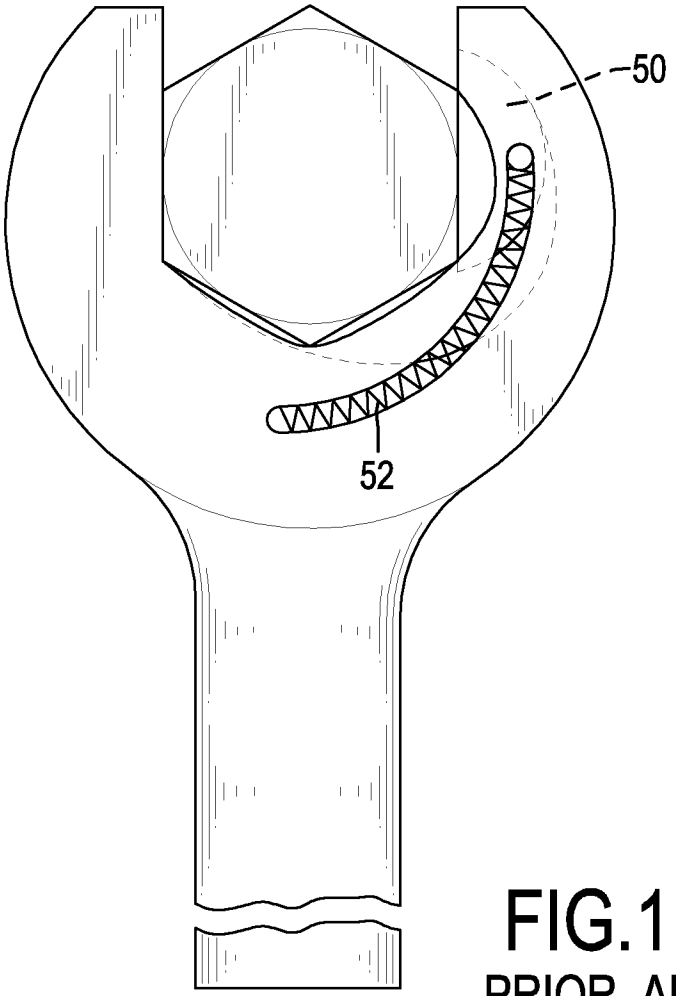
FIG.11 PRIOR ART
Figure 13:
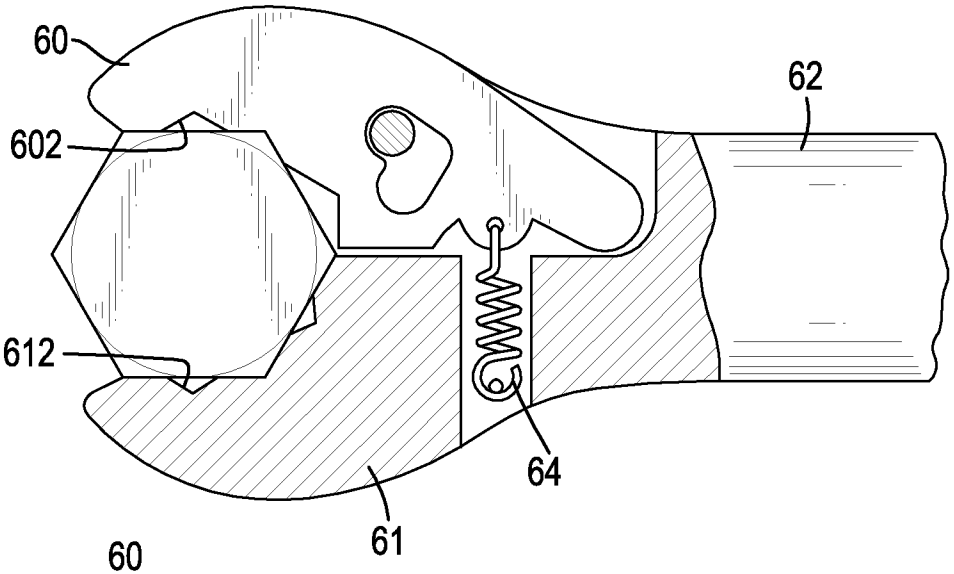
FIG.13 PRIOR ART
FIGS. 13 and 14 are side views in partial section of another conventional wrench shown in U.S. Pat. No. 5,018,412.
Figure 14:
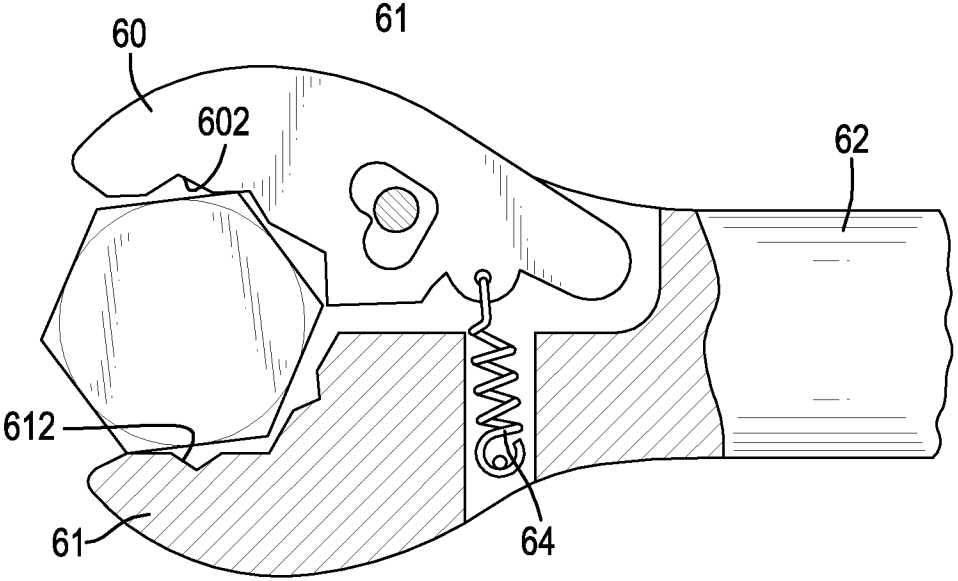
FIG.14 PRIOR ART
Figure 16:
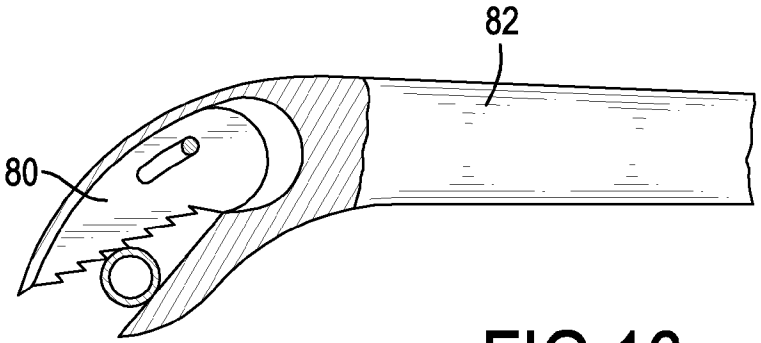
FIG.16 PRIOR ART
FIG. 16 is a side view in partial section of a conventional pipe wrench shown in U.S. Pat. No. 385,595.
Figure 15:
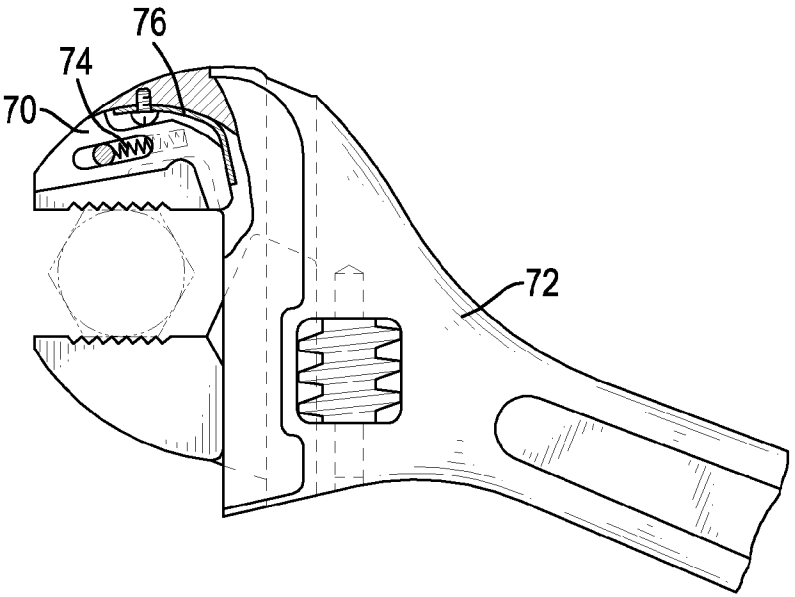
FIG.15 PRIOR ART
FIG. 15 is a side view in partial section of another conventional wrench shown in U.S. Pat. No. 4,706,528.

With reference to FIG. 9, in the alternative embodiment, the positions of the ratchet jaw 14' and the stationary jaw 15' can be exchanged from each other to meet different needs of operations.

Therefore, the unidirectional ratchet wrench in accordance with the present invention does not require a tapered coil spring so is cheaper to produce. Further, the arced slot 16 is not formed through the sides of the ratchet jaw 14 so does not weaken the ratchet jaw as much as forming a slot through the sides of the ratchet draw. The previous consideration also allows further miniaturization of the unidirectional ratchet wrench as described for implementation with smaller bolt heads, thereby forming new markets.

Moreover, when the unidirectional ratchet wrench as described is used for a bolt in different size, the ratcheting assembly 20 will slide by the arced slot 16 to adjust the best position for the bolt, so the unidirectional ratchet wrench as described is applicable for bolts slightly different in sizes.

Finally, the unidirectional ratchet wrench in accordance with the present invention has a piece with an arced slot 16 and does not need to weld any support to strengthen the piece. The structural strength of the unidirectional ratchet wrench as described is enough for bearing a shock.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A unidirectional ratchet wrench comprising:

a wrench body comprising a handle; and a head being formed on and protruding from the handle and having two edges;

a stationary jaw formed on and protruding from one edge of the head and having an undulating surface and having a limiting protrusion formed on and protruding from a position adjacent to a distal end of the undulating surface of the stationary jaw;

a supporting protrusion formed on the undulating surface of the stationary jaw;

an engaging protrusion formed on the undulating surface of the stationary jaw between the limiting protrusion and the supporting protrusion;

a first recess with a curved bottom defined between the limiting protrusion and the engaging protrusion; and a second recess with a curved bottom defined between the engaging protrusion and the supporting protrusion; and a ratchet jaw formed on and protruding from other edge of the head to form a space between the ratchet jaw and the stationary jaw for holding a tool head and having a distal end away from the handle;

an inner surface;

two side surfaces; and an arced slot formed in the inner surface of the ratchet jaw and having an inner surface that has a curvature; and a ratcheting assembly mounted in the arced slot and comprising an engaging tab movably mounted in the arced slot, being arced and comprising an inner surface;

an outer surface abutting the inner surface of the arced slot;

a tip end away from the distal end of the ratchet jaw and extending out of the arced slot and into the space between the ratchet jaw and the stationary jaw;

a blunt end being adjacent to the distal end of the ratchet jaw, extending out of the arced slot and into the space between the ratchet jaw and the stationary jaw and having a width wider than that of the tip end; and a guide hole formed through the engaging tab, being curved and having a curvature having a center same as that of the curvature of the inner surface of the arced slot;

a drive end; and a non-drive end disposed near the blunt end and disposed opposite to the drive end; and a pin mounted movably through the guide hole and securely in the side surfaces of the ratchet jaw, wherein the engaging protrusion having a contacting point adapted for abutting with a flat on the tool head;

the supporting protrusion having a contacting point adapted for abutting with another flat on the tool head; and the contacting points on the engaging protrusion and the supporting protrusion have an included angle of 60 degree.

2. The unidirectional ratchet wrench as claimed in claim 1, wherein the outer surface of the engaging tab corresponds to the inner surface of the arced slot.

3. The unidirectional ratchet wrench as claimed in claim 2, wherein the engaging protrusion has a tangent line having an included angle relative to a tangent line of the supporting protrusion being 60 degrees.

4. The unidirectional ratchet wrench as claimed in claim 3, wherein a ratcheting space is formed between the drive end of the guide hole and the pin to allow the ratcheting assembly to slightly slide in a non-drive direction.

5. The unidirectional ratchet wrench as claimed in claim 4, wherein the ratchet jaw further has two pinholes being respectively formed through the side surfaces of the ratchet jaw and communicating with the arced slot; and the pin is mounted in the pinholes.

6. The unidirectional ratchet wrench as claimed in claim 3, wherein the ratchet jaw further has two pinholes being respectively formed through the side surfaces of the ratchet jaw and communicating with the arced slot; and the pin is mounted in the pinholes.

7. The unidirectional ratchet wrench as claimed in claim 2, wherein a ratcheting space is formed between the drive end of the guide hole and the pin to allow the ratcheting assembly to slightly slide in a non-drive direction.

8. The unidirectional ratchet wrench as claimed in claim 7, wherein the ratchet jaw further has two pinholes being respectively formed through the side surfaces of the ratchet jaw and communicating with the arced slot; and the pin is mounted in the pinholes.

9. The unidirectional ratchet wrench as claimed in claim 2, wherein the ratchet jaw further has two pinholes being respectively formed through the side surfaces of the ratchet jaw and communicating with the arced slot; and the pin is mounted in the pinholes.

10. The unidirectional ratchet wrench as claimed in claim 1, wherein the engaging protrusion has a tangent line having an included angle relative to a tangent line of the supporting protrusion being 60 degrees.

11. The unidirectional ratchet wrench as claimed in claim 10, wherein a ratcheting space is formed between the drive end of the guide hole and the pin to allow the ratcheting assembly to slightly slide in a non-drive direction.

12. The unidirectional ratchet wrench as claimed in claim 11, wherein the ratchet jaw further has two pinholes being respectively formed through the side surfaces of the ratchet jaw and communicating with the arced slot; and the pin is mounted in the pinholes.

13. The unidirectional ratchet wrench as claimed in claim 10, wherein the ratchet jaw further has two pinholes being respectively formed through the side surfaces of the ratchet jaw and communicating with the arced slot; and the pin is mounted in the pinholes.

14. The unidirectional ratchet wrench as claimed in claim 1, wherein a ratcheting space is formed between the drive end of the guide hole and the pin to allow the ratcheting assembly to slightly slide in a non-drive direction.

15. The unidirectional ratchet wrench as claimed in claim 14, wherein the ratchet jaw further has two pinholes being respectively formed through the side surfaces of the ratchet jaw and communicating with the arced slot; and the pin is mounted in the pinholes.

16. The unidirectional ratchet wrench as claimed in claim 1, wherein the ratchet jaw further has two pinholes being respectively formed through the side surfaces of the ratchet jaw and communicating with the arced slot; and the pin is mounted in the pinholes.

* * * * *